United States Patent [19]

Skogmo et al.

[11] Patent Number: 4,680,434

[45] Date of Patent: Jul. 14, 1987

[54] EXPLOSIVE-DRIVEN, HIGH SPEED, ARCLESS SWITCH

[75] Inventors: Phillip J. Skogmo; Tillman J. Tucker, both of Albuquerque, N. Mex.

[73] Assignee: The United States of America as represented by the United States Department of Energy, Washington, D.C.

[21] Appl. No.: 859,164

[22] Filed: May 2, 1986

[51] Int. Cl.[4] ..... H01H 39/00

[52] U.S. Cl. ..... 200/61.08

[58] Field of Search ..... 200/82 B, 61.08, 151; 337/6, 401

[56] References Cited

U.S. PATENT DOCUMENTS

| | | | |
|---|---|---|---|
| 2,929,892 | 3/1960 | Blomgren | 200/61.08 |
| 3,269,987 | 8/1966 | Alston et al. | 200/61.08 |
| 3,748,418 | 7/1973 | Kawasaki | 200/82 B |
| 3,819,890 | 6/1974 | Kozorezov et al. | 200/61.08 |
| 3,848,099 | 11/1974 | Christian et al. | 200/61.08 |
| 3,848,100 | 11/1974 | Kozorezov et al. | 200/61.08 |
| 3,851,219 | 11/1974 | Kozorezov et al. | 361/103 |
| 3,932,717 | 1/1976 | Dike et al. | 200/61.08 |
| 4,174,471 | 11/1979 | Ford et al. | 200/61.08 |
| 4,296,285 | 10/1981 | Lang et al. | 200/61.08 |
| 4,342,978 | 8/1982 | Meister | 337/6 |
| 4,370,531 | 1/1983 | Tobin | 200/151 |
| 4,472,704 | 9/1984 | Jackson et al. | 337/6 |
| 4,490,707 | 12/1984 | O'Leary | 337/6 |

OTHER PUBLICATIONS

P. S. Levi, et al, "Staged Explosively Driven Opening Switch Development for Explosive Flux Compression Generators", Air Force Weapons Laboratory: date unknown.

*Primary Examiner*—J. R. Scott

*Attorney, Agent, or Firm*—George H. Libman; Judson R. Hightower

[57] ABSTRACT

An explosive-actuated, fast-acting arcless switch contains a highly conductive foil to carry high currents positioned adjacent a dielectric surface within a casing. At one side of the foil opposite the dielectric surface is an explosive which, when detonated, drives the conductive foil against the dielectric surface. A pattern of grooves in the dielectric surface ruptures the foil to establish a rupture path having a pattern corresponding to the pattern of the grooves. The impedance of the ruptured foil is greater than that of the original foil to divert high current to a load. Planar and cylindrical embodiments of the switch are disclosed.

14 Claims, 7 Drawing Figures

EXPLOSIVE-DRIVEN, HIGH SPEED, ARCLESS SWITCH

The U.S. Government has rights in this invention pursuant to Contract No. DE-AC04-76DP00789 between the U.S. Department of Energy and AT&T Technologies, Inc.

TECHNICAL FIELD

This invention relates generally to small, one-time, fast-opening switches for very high currents of the type encountered in pulse power applications, such as plasma heating, and particularly to such switches that operate without electric arcing.

BACKGROUND OF THE INVENTION

It is often necessary to interrupt or divert very high currents in electrical circuits by the opening of a switch, either in the path of the current or in a parallel circuit loop. Since very high currents are typically associated with very high electrical voltages, either at the voltage source or as a result of inductance in the circuit, the opening of such a switch almost inevitably results in the creation of an electric arc between the terminals that have been disconnected. The establishment of such an arc increases the effective opening time of the switch, encourages faults in the switch to occur and can be dangerous.

Various means exist for preventing or extinguishing such electric arcs in switches, such as by air blasting, exploding wire fuses, and high explosive driven arc quenching devices. Low arcing switches carrying high currents are used in inductively stored pulse power applications to open the primary storage inductance. As regards protection devices such as circuit breakers, however, the high current arc, once formed, is very difficult to extinguish. All of the above mentioned devices have serious limitations regarding their size, speed, initial circuit loading, and the magnitude and/or duration of the switch operating resistance profile.

Explosive-driven circuit breakers and switches which utilize the power of an explosion to separate electrical contacts or to break an electrically conductive path, and sometimes to simultaneously blow away the resultant arc, are well known. U.S. Pat. No. 3,851,219, to Kozorezov et al, titled "Circuit-Opening Device For Interrupting Heavy Currents By Means of An Explosive Charge", for example, teaches the use of two hollow conductors made of a material with a low density and high thermal and electrical conductivity, e.g., magnesium or aluminum, and an explosive cartridge within each, with the two connected in parallel. When the explosive charge of one of the cartridges is set off, the hollow conductor disintegrates, and current flow therethrough is interrupted.

U.S. Pat. No. 4,342,978, to Meister, titled "Explosively-Actuated Switch and Current Limiting, High Voltage Fuse Using Same", discloses the use of an explosive to drive apart two earlier contacting electrical contacts by means of a piston which is made of a material that ablates to produce gases which extinguish the electric arc that results.

Other devices in which one or two gaps generated by an explosion are shielded by means of arc extinguishing gas or by containment within an insulating element are exemplified by U.S. Pat. No. 4,370,531, to Tobin, U.S. Pat. No. 4,472,704, to Jackson et al, and U.S. Pat. No. 4,490,707 to O'Learyl.

In "Staged Explosively Driven Opening Switch Development for Explosive Flux compression Generators", by Levi et al published by the Air Force Weapons Laboratory, the by-products of the explosion are directed across the arc formed when a circuit is disrupted by an explosive-activated switch to extinguish the arc. A switch of this kind, wherein an aluminum conductor carrying a current is broken apart by an explosive cord is described in "High Recovery Voltage Switch for Interruption of Large Current", Ford et al, Rev. Sci. Instrum. 53(7), July 1982.

$SF_6$ is used for arc interruption in high current switches in "Advances in High Voltage Insulation and Arc Interruption in $SF_6$ and Vacuum", by Maller et al, Pergamon Press at chapter 4, pages 100–108, and the use of gas with or without an explosive to effectuate separation of high current electrical contacts is described in U.S. Pat. No. 3,748,418, to Kawasaki, titled "Tank-Type Gas-Filled Circuit Breaker With Impulsive Seal Breaking Means for Initiating Piston Operation".

As best seen in FIG. 1, a simple stored power circuit 10, of the type common to pulse power operations, consists of two loops with one comprising a power storing capacitance 14 connected generally in series with a storage inductance 15 and a switch 12 to provide a primary conductive path for a current A when the switch is closed. The second loop connected in parallel with switch 12, comprises a switch 11 and a load 13, such that if switch 11 is closed and switch 12 is open, a current B will flow through the load 13.

Assume that capacitor 14 is initially charged by a voltage source (not shown). To obtain a power pulse through the load 13, switch 12 is initially closed and switch 11 is open establishing only current loop A. Then, at a predetermined time, switch 12 is opened and, thereafter, switch 11 is closed, thereby directing current from the primary circuit to the load 13. Because the opening of switch 12 will result in the formation of an electric arc due to inductance 15 in the circuit, the application of current to the load 13 by the closure of switch 11 is somewhat delayed. It is therefore desirable, for high speed switching, to have an arcless driversin of the primary current through the associated secondary part of the circuit.

Although there are numerous switching devices to obtain current interruption and extinguishment of the resultant arc, there exists a need for a method and apparatus for controllably and rapidly increasing the electrical impedance of an opening switch element in inductive type high power pulse generating circuitry to provide safe and reliable power pulse generation.

SUMMARY OF THE INVENTION

It is an object of this invention to provide apparatus for explosive-driven, high speed, arcless interruption of a high current flow in an electric circuit.

It is another object of this invention to provide apparatus for explosive-driven, high speed, arcless interruption of a high current flow in an electric circuit by the development of a high impedance therein.

It is yet another object of this invention to provide apparatus for explosive-driven, controlled, high speed, arcless diversion of current from a primary storage circuit to provide pulse power to a connected secondary circuit.

It is a further object of this invention to provide apparatus for explosive-driven, controlled, high speed, arcless interruption of a current flow in excess of a predetermined amount in a high current electric circuit.

It is, furthermore, another object of this invention to provide a method for the explosive-driven, controlled, high speed, arcless interruption of a high current flow in an electric circuit.

It is a further object of this invention to provide an inductive stored-power circuit for delivering a controlled, high speed, arcless power pulse to an electric load.

It is an even further object of this invention to provide a high current circuit that is protected against power overload by a controlled, high speed, arcless interruption of an unacceptably high current flow therein.

These and other objects of this invention are realized by the provision of a fast-acting, arcless switch comprising a frangible conductive foil element adjacent a hard dielectric surface formed with a pattern of grooves. An explosive on one side of the foil opposite the dielectric surface is set off in response to an external electrical signal. The force of the explosion forces the conductive foil against the groove dielectric surface to cut the conductive foil into a configuration, determined by the groove pattern, that has a higher finite impedance than it had prior to being forcibly cut. This sudden increase in the impedance of the conductive foil causes current flowing therethrough to be diverted into other paths in the circuit without arcing across open contacts.

In one embodiment of this invention, a conductive foil strip having a low initial impedance, connected to carry current in an electrical circuit, e.g., in shunt with a load, is positioned near a hard dielectric formed into an array of cutting ridges separated by grooves. Adjacent the side of the conductive foil strip away from the groove dielectric surface is a flexible insulating layer followed by an explosive. The explosive is actuated by a control signal to generate a force driving the conductive foil against the hard grooves and ridges to slice the foil into a serpentine configuration having a higher impedance than that of the unsliced foil.

In another embodiment, the conductive foil has a cylindrical configuration and a correspondingly cylindrical hard dielectric cutting surface is formed to have a helical groove so that the force of the explosion tears the conductive foil from its initial cylindrical form into a helical spiral form having a higher finite electrical impedance comprising both a higher resistance and a substantial inductance. The cylindrical dielectric grooved surface in one version of the preferred embodiment is radially external to the conductive foil, and the explosion exerts a radially outward force to tear the foil into a helix. In a second version of the preferred embodiment the conductive foil surrounds the hard dielectric grooved cylinder and is forced against it radially inward, by the implosive forces of a surrounding explosive element, to obtain a helical high impedance helical element in place of the original low impedance cylindrical conductive foil.

The above and still further objects, features and advantages of the present invention will become apparent upon consideration of the following detailed description of several specific embodiments thereof, especially when taken in conjunction with the accompanying drawings.

BRIEF DESCRIPTION OF THE DRAWINGS

The same reference numbers are used in the different diagrams of the drawings to identify the same elements.

BEST MODE FOR PRACTICING THE INVENTION

An electric switch or circuit breaker is conventionally thought of as apparatus which physically disrupts the current conductive path in an electric circuit, typically by moving apart two otherwise contacting highly conductive electrical contacts or by physically disrupting the electrical path through a single electrical contact. In accordance with the various embodiments of the arcless switch according to this invention, however, a very high, finite, time-dependent impedance is introduced into a current loop to controllably limit the current flow therethrough. Because actual physical separation of two contacting conductive elements or the physical disruption of a conductive path is avoided by this invention, there is inherently the avoidance of an undesirable electric arc in the course of this operation.

In this normally conductive, or "closed", state, the apparatus of this invention comprises a highly conductive current-carrying element, most conveniently in the form of a thin metal foil that is either flat or cylindrical depending upon the selected configuration. Likewise, in its "open"-state, the apparatus of this invention comprises the same conductive element but with a modified geometry of the conductive element obtained by the direction of an explosive force to cause rupture of that element along a preselected groove pattern in a hard dielectric element adjacent the conductive element. When the conductive element is selected to be of a flat thin configuration, the process of opening the switch causes substantially only its resistance to increase. When the conductive element is selected to be in the form of a thin cylindrical foil, however, the operation of the switch introduces a very high time-dependent impedance that comprises both an increased resistance and an increased electrical inductance. In either case, because there is no separation of electrical contacts, the generation of an electric arc and the problems associated therewith are avoided.

Figure 2:
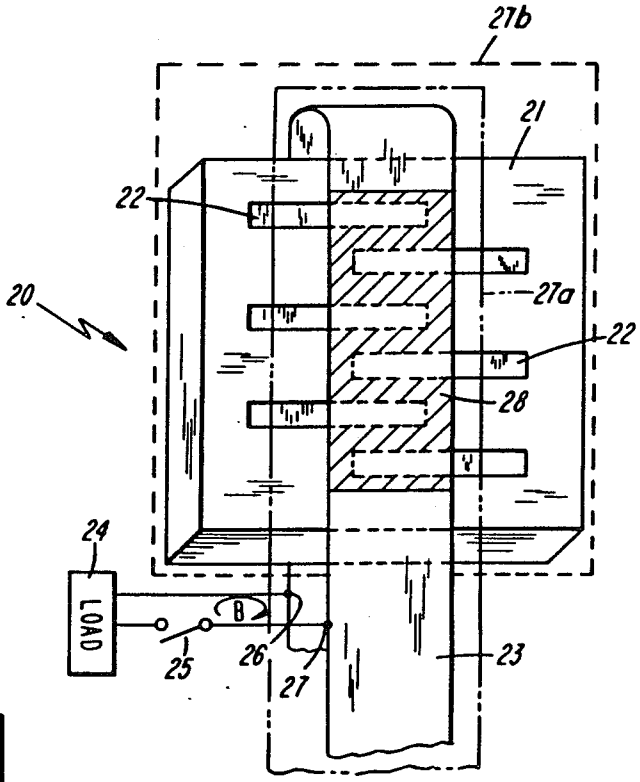
FIG. 2 is a view of a first embodiment of the apparatus according to this invention wherein the dielectric surface and conductive foil are planar.

In a first embodiment 20 of this invention, as best seen in FIG. 2, an undeformed, thin, flat, highly conductive foil 23 carries a high electric current in a circuit. This foil 23, initially having a uniform cross-sectional area within the switch, is placed adjacent a hard dielectric block 21 that has formed within it grooves 22 which are primarily two sets of parallel grooves that include an overlap along their lengthwise direction. The secondary loop of a circuit containing foil 23 comprises a load 24 connected through a secondary switch 25 to foil 23 at two points, 26 and 27 respectively. the switch according to this embodiment comprises further an explosive element 27*a* (shown in a phantom line) disposed over a flexible dielectric layer on foil 23 and any known explosive actuating element (not shown) contained within a strong outer casing 27*b* (shown in a dotted line) together with dielectric block 21.

When actuation of the switch is desired, a signal is sent to the explosive actuating element to cause the explosive to be set off within a confined space defined by the casing 27*b* so that the explosive force acting preferably via the flexible dielectric element or layer (not shown) lying across foil 23 will cause a mechanical rupture in conductive foil 23 at each of the grooves over which it extends. As a result, when the ruptures are complete, element 23, over the zone defined by the grooves in adjacent hard dielectric element 21, will have a serpentine form 28 (as indicated by shading in FIG. 2) with a greater length and a much reduced cross sectional area through which the electrical current now flows.

The reduction in the conductive material cross-section available to the current flowing through ruptured foil 28 as compared to original foil 23, the increase in the conductor length over the zone defined by the grooves along which the ruptures occur, and the resultant heating of this high resistance modified portion of element 23 as a result of the explosion is accompanied by an increase in the electrical resistivity of the foil due to heating. Explosive actuation of the switch according to this embodiment accordingly results in a sudden increase in the impedance of the circuit loop in which switch 20 is located.

Figure 3:
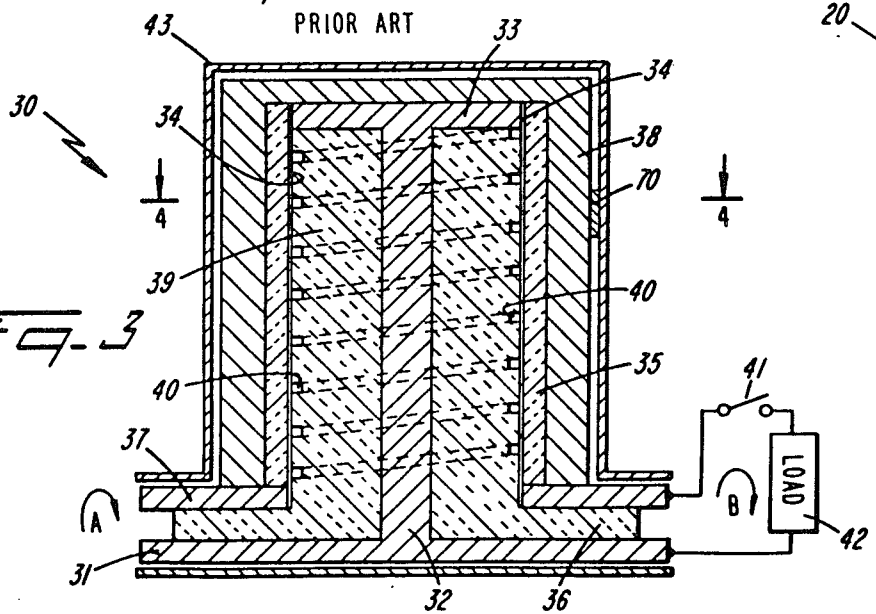
FIG. 3 is a vertical cross-sectional view of a second embodiment of this invention, in which a grooved dielectric former is located inside a cylindrical conductive foil element.
Figure 4:
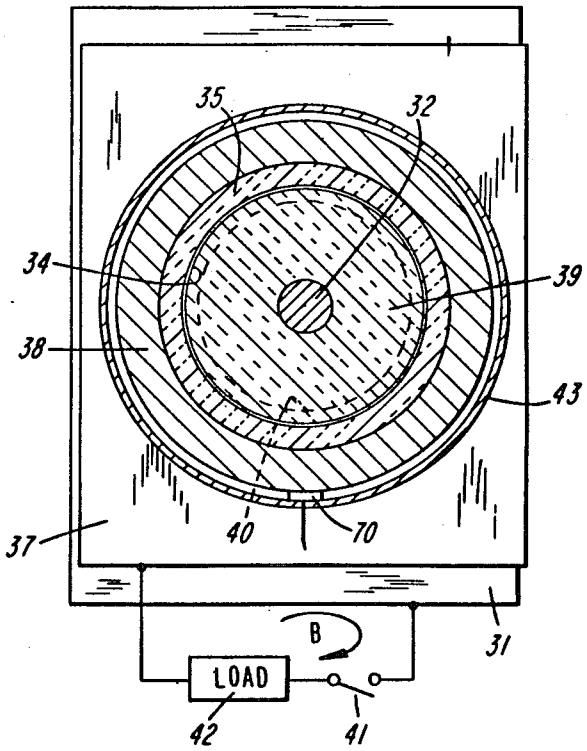
FIG. 4 is a plan cross-sectional view of the embodiment of FIG. 3 at section 4—4 (casing omitted).

In a second embodiment of this invention, shown in FIGS. 3 and 4, a highly conductive material, e.g., copper, is formed to have a substantially flat base 31 normal to which is an integral stem portion 32 topped off, preferably, by a circuit flat head 33 integral therewith. Immediately surrounding stem portion 32, and extending between base 31 and head 33 of the conductive material, is a substantially cylindrical hard dielectric former having a base portion 36 and an annular cylindrical portion 39. A suitable material for the dielectric former is a hard phenolic resin of the type commonly used to cast plastics materials. Machined or otherwise formed into the outside cylindrical surface of portion 39 of the dielectric former is a spiral cylindrical groove 40. This groove 40 preferably extends from head 33 to a point very close to base 36 of the dielectric element.

Immediately outside cylindrical portion 39 and above base 36 of the dielectric element is an annular flat conductive element 37. A thin, cylindrical, highly conductive element 34 surrounds the central portion of the assembly. Element 34 extends from the top of head 33 to the central aperture of the second conductive element 37. As is readily apparent, an electric current provided to base 31 of the first electrically conductive element will travel through stem 32 and head 33 thereof, through the thin cylindrical foil conductive element 34, to the connected second electrically conductive element 37. This, in effect, would be the situation were switch 12 to be closed in FIG. 1 and have this particular configuration of the invention.

In order to obtain an effective "opening" of the switch, a thin, flexible, dielectric, cylindrical sleeve 35 is located outside the cylindrical conductive foil element 34 and extends from the second electrically conductive element 37 to the top of the conductive cylindrical foil element 34, as best seen in FIG. 3. The purpose of this flexible dielectric element is, first, to ensure that there is no electrical contact between the cylindrical conductive foil element 34 and any parts of the casing of the switch, and also to ensure that the explosive force that will be applied to modify the geometry of cylindrical conductive element 34 is evenly distributed to act along groove 40. Dielectric sleeve 35 may conveniently be made of a material such as Teflon (TM).

A cylindrical, preferably cup-shaped, shell made of a suitable known explosive material 38 surrounds flexible dielectric sleeve 35 and covers the top of head 33 of the first conductive element, as shown in FIG. 3. The entire assembly is best contained inside a strong casing 43 to contain the force of the explosion obtained by setting off explosive element 38 while permitting electrical connections to be made to the first electrically conductive element base 31 and the second electrically conductive element 37. As indicated in FIG. 3, an electrical load 42 may be connected across the conductive elements of the switch by way of a secondary switch 41 to provide a possible path for a secondary current B. Likewise, a primary current A can be provided by connection of the first conductive element base 31 and the second conductive element 37 with elements such as capacitor 14 and inductance 15, as best seen in FIG. 1.

Figure 1:
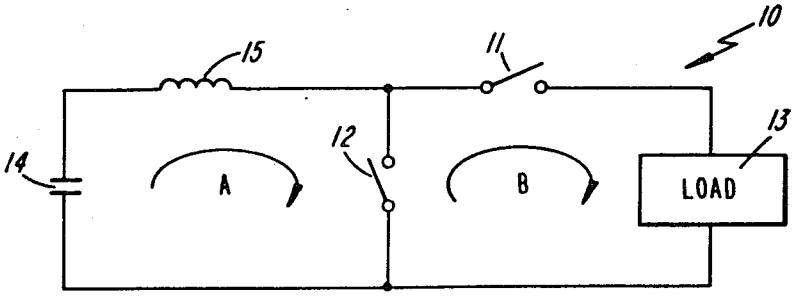
FIG. 1 PRIOR ART
FIG. 1 is a simplified circuit suitable for pulse power generation.

In practice, switch 30 is connected where switch 12 is indicated in FIG. 1. At a predetermined time, in response to an external signal, and by means of an explosive actuating device 70 of known type, explosive element 38 is set off so that the explosive force contained within casing 43 acts radially inward over the surface of flexible dielectric element 35 and thus on the conductive foil element 34. Since conductive foil element 34 does not have mechanical support along groove 40 there is a physical rupture of conductive element 34 along the length of groove 40. The result, as intended, is to geometrically change the cylindrical highly conductive element 34 into a helical conductive element along the land area defined by the groove 40. This sudden, controlled, deliberately obtained change in the geometry of conductive element 34 has the effect of increasing its electrical impedance to current therethrough by a reduction in the conductor cross-sectional area available, an increase in the conductor length, a time-related increase in the electrical resistivity of the modified conductor due to increased temperature and, significantly, by the production of a positive time rate of change of the inductance of that element which now has a spiral cylindrical form. Actuation of the explosive element 38 while a primary current A is flowing between first conductive element base 31 and the second conductive element 37 increases the impedance of that arm of the circuit significantly. Secondary switch 41 is now closed, whereupon the current pulses through load 42. Graphical depictions of the variation of electrical current as a function of time, for two such test cases, are provided in FIGS. 6 and 7.

Note that actuation of switch 30 at no point requires a physical break in the integrity of the conductive element carrying the current. As a result there is never any occasion for an electric arc to be established. Thus arc-related problems are inherently avoided and an arcless interruption of a high current flow through the switch is obtained.

Figure 5:
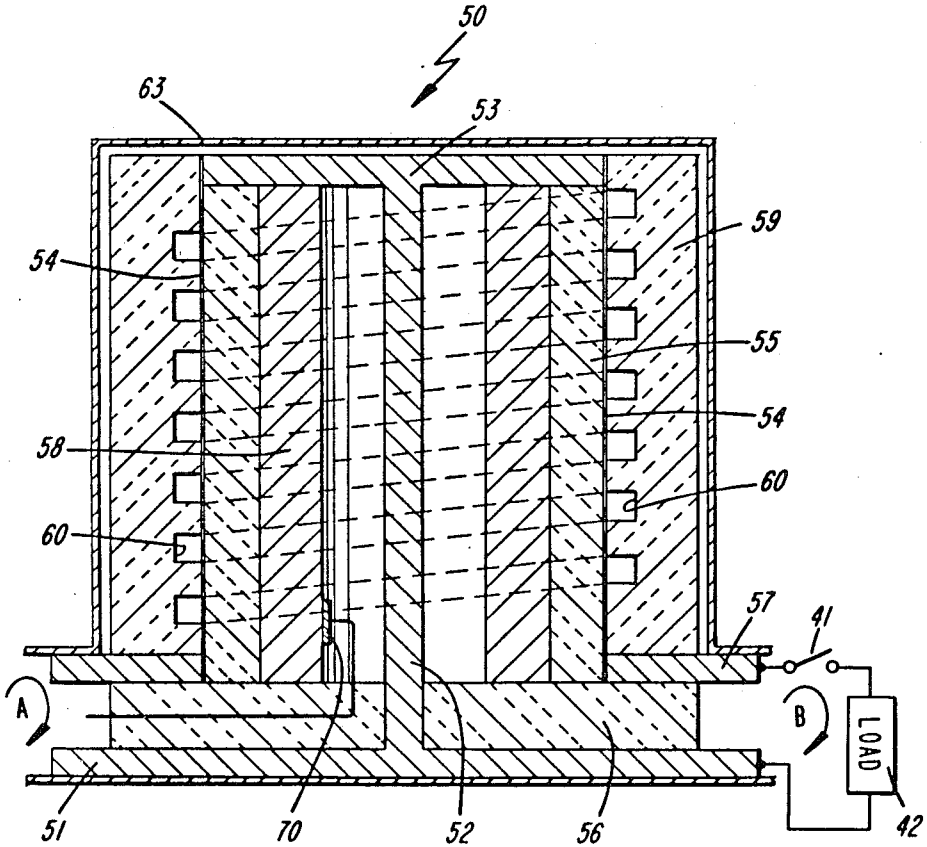
FIG. 5 is a vertical cross-sectional view of a modified form of the embodiment of FIG. 3, in which a cylindrical dielectric grooved former is located outside a cylindrical conductive element of an electric circuit.

In an alternative embodiment 50, as shown in FIG. 5, a first conductive element has a base 51, a stem 52 integral therewith at one end, and a head 53 integral with the stem at its other end. A flat annular dielectric element 56 is disposed about stem 52 of the first conductive element and in contact with base 51 thereof. A hollow cylindrical exposive sleeve 58 is placed coaxially with stem 52 of the first conductive element and is surrounded by a flexible hollow dielectric sleeve 55 whose outer periphery preferably matches that of head 53 of the first conductive element. Immediately outside of sleeve 55 is a thin, highly conductive, cylindrical foil element 54 which is connected at one end to head 53 of the first conductive element and at its other end to a flat, annular, second electrically conductive element 57 positioned adjacent to the first dielectric element 56. Thus dielectric element 56 serves as an electrical insulator between the electrically conductive elements 51 and 57.

Immediately surrounding the thin conductive foil element 54 is a hard dielectric cylinder 59, formed to have a spiral cylindrical groove 60 around its inner periphery. The entire assembly is contained in a strong casing 63 which allows access to the first and second conductive elements 51 and 57, respectively, for electrical connection thereby with an external circuit as indicated in FIG. 5. Embodiment 50, as illustrated in FIG. 5, operates in substantially the same manner as embodiment 30, illustrated in FIG. 3. Not shown in both FIGS. 3 and 5 are details of the explosive sleeve actuating means, which may be of any known type.

In embodiment 50, the setting off of explosive sleeve 58 within the casing generates forces that act radially outward and force flexible sleeve 55 against conductive foil element 54. The exertion of this force against the foil over the spiral cylindrical groove ruptures the foil and forces its geometry to take the form of a spiral coil between head 53 of the first conductive element 51 and the second conductive element 57, thereby very rapidly introducing a very high impedance into the circuit. As before, the increase in the impedance of conductive element 54 is obtained due to a reduction in the conductive cross-section available to the flow, an increase in the conductor length between the first and second electrically conductive elements 51 and 57 by the production of a positive time rate of change of the switch inductance, and due to a heating of the conductor with an associated increase in its electrical resistivity.

As indicated in FIG. 1, electrical power stored in a first circuit can be diverted by the deliberate action of two switches, typified by switch 12 according to one of the embodiments of this invention and a conventional switch 11, in a secondary circuit connected to a load. When switch 12 is opened, and switch 11 is closed thereafter in a programmed sequence, a surge or pulse of power from the primary circuit is directed through the load 13 in the secondary circuit. When a conventional switch or circuit breaker is used as the switch 12 in the circuit of FIG. 1, the generation of an arc across the terminals being separated during the opening of switch 12 will effectively delay the transfer of power from the primary to the secondary circuit. Such a time delay may be unacceptable for pulse power applications.

Likewise, when a switch according to one of the embodiments of this invention is used as a protective element in a circuit containing sensitive elements, the activation of the switch causes a very severe and controlled but fast reduction in the current flowing therethrough. This, by careful placement within the circuit, can serve to provide swift and controlled protection of sensitive elements in series with the switch. If a conventional switch were used in such a circuit, as before, the generation of an arc during the opening of the switch may delay the effectiveness of the protective action to an unacceptable degree.

By avoiding the formation of an arc altogether, therefore, the various embodiments of the fast acting arcless switch according to this invention avoid the problems of arcing entirely and do not require the complex, expensive, bulky, and sometimes unreliable arc-extinguishing apparatus that is found in conventional high current switch gear. The application of this apparatus, either in pulse power applications or as a fault responsive circuit breaker, involves a method considerably different from that encountered in other known techniques utilizing the force of an explosion to obtain high current interruption in a circuit. Specifically, by careful choice of geometries and sizes, a highly conductive thin cylindrical element is rapidly transformed by the action of the controlled explosion into a high impedance element without any arcing whatsoever.

Naturally, because this deformation of the conductive element is permanent, this switch is suitable only for single use purposes. Once the switch has acted, and has served to open a high current circuit, it must be replaced as it cannot be reset like a simple conventional switch or circuit breaker. However, because of its very simple construction and the use of commonly available elements, the cost of replacing such a switch after each use is generally far outweighed by the security and benefits provided by its arcless operation.

Figure 6:
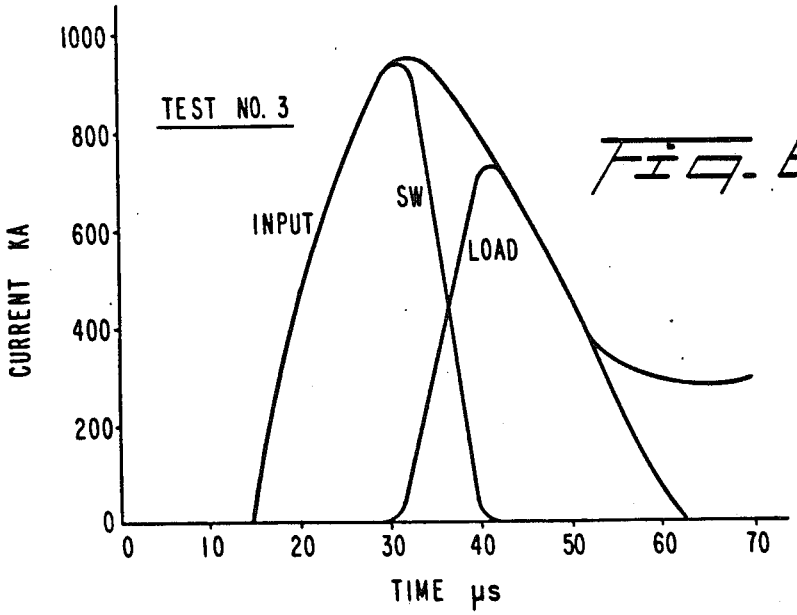
FIGS. 6 and 7 are two plots of input, switch and load currents, measured in two tests of a cylindrical arcless switch of this invention in a circuit according to FIG. 1.
Figure 7:
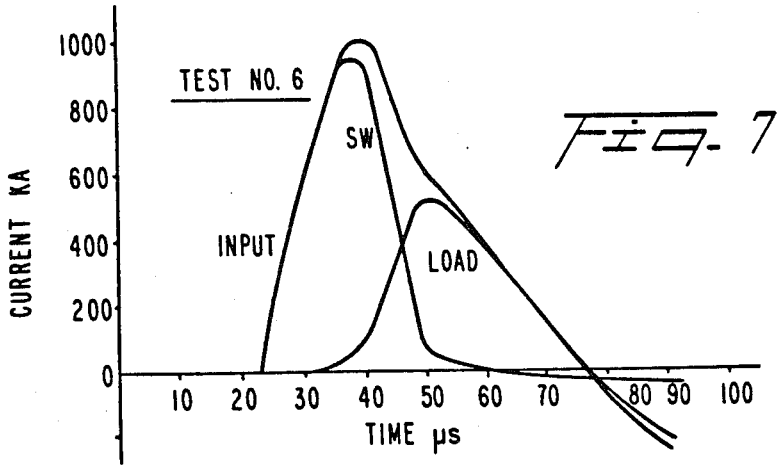

Table 1 below summarizes some test data obtained from a circuit as illustrated in FIG. 1, in which a switch according to this invention was utilized to transfer pulse power to a load. As in seen from the first column in Table 1, high currents of up to 2000 kA can be handled by a switch according to this invention to effect a very high rise in current over a very short period of time through the load, i.e., a swift pulse power transfer is conveniently obtained. FIGS. 6 and 7, respectively, present the plotted test data from two such tests and illustrate the time history of the input current (INPUT), the current flowing through the switch (SW), and the current flowing through the load (LOAD), respectively, in each case. Obviously, a switch designer seeking to utilize the teachings of this invention may use experimental data of this type to select the geometry, the materials, and the operating parameters that are essential under given circumstances to obtain reliable use of this swift-acting, high-current, explosive-driven arcless switch.

It should be apparent from the preceding that this invention may be practiced otherwise than as specifically described and disclosed herein. Modifications may, therefore, be made to the specific embodiments disclosed here without departing from the scope of this invention and are intended to be included within the claims appended below.

TABLE 1

| TEST NO. | PEAK INPUT CUR-RENT (kA) | PEAK CURRENT TO LOAD (kA) | LOAD CURRENT 10–90% (usec.) | PEAK SWITCH VOLTAGE (kV) |
|---|---|---|---|---|
| 1* | 500 | −50 | 10 | 1 |
| 2* | 500 | +150 | 10 | 2 |
| 3* | 950 | 740 | 6.2 | 4.5 |
| 4** | 1000 | 250 | 20 | 3 |
| 5** | 2000 | 1600 | 7.4 | 9.5 |
| 6** | 1000 | 520 | 7.0 | 7.0 |

*Test of switch of FIG. 5 with a 4" diameter, 5" long cutter assembly.
**Test of switch of FIG. 3 with a 4" diameter, 5" long cutter assembly.

What is claimed is:

1. An explosive-actuated, single-use, fast-acting, arcless switch for a high current circuit, comprising:

a frangible conductive foil element having opposed first and second surfaces providing a low impedance path between an input and an output for a high current in said circuit;

a hard dielectric surface positioned against the first surface of said frangible foil and provided with a predetermined pattern of grooves, the surface between said grooves extending from said input to said output; and explosive force-generating means for generating an explosive force acting on the second surface of said frangible foil towards said grooved hard dielectric surface, said foil over said grooves being ruptured by said explosive force, thereby providing a current path only through the unruptured foil between said grooves to increase the impedance of said switch between said input and said output.

2. An explosive-actuated, single use, fast-acting, arcless switch for a high current circuit, according to claim 1, further comprising:

a flexible dielectric layer adjacent said second surface of said foil.

3. An explosive-actuated, single use, fast-acting, arcless switch for a high current circuit, according to claim 2, wherein said explosive force-generating means comprises an amount of explosive material adjacent to said flexible dielectric layer, said material sandwiching said layer against said foil.

4. An explosive-actuated, single use, fast-acting, arcless switch for a high current circuit, according to claim 1, further comprising:

explosive actuating means for actuating said explosive force-generating means in response to a predetermined input.

5. An explosive-actuated, single use, fast-acting arcless switch for a high current circuit, acording to claim 1, further comprising:

connection means for connecting said arcless switch to an electrical circuit.

6. An explosive-actuated, single use, fast-acting, arcless switch for a high current circuit, according to claim 1, wherein:

said hard dielectric surface is substantially flat between grooves.

7. An explosive-actuated, single use, fast-acting, arcless switch for a high current circuit, according to claim 1, further comprising:

a strong protective external casing surrounding said explosive force-generating means, for controlled management of the end products from said explosive force-generating means.

8. An explosive-actuated, single-use, fast-acting, arcless switch for a high current circuit, according to claim 1, wherein:

said foil element comprises a cylindrical foil element having an inner and an outer surface; and said hard dielectric surface comprises a fixed cylindrical cutter having a cutter surface coaxial with one of said inner or outer surfaces of said foil element, a portion of said cutter surface being formed to have a helical groove adjacent the first surface of said foil element.

9. An explosive-actuated, single-use, fast-acting, arcless switch for a high current circuit, according to claim 8, wherein:

said cutter surface is an external surface of said cylindrical cutter, and the first surface of said foil element is said inner surface.

10. An explosive-actuated, single-use, fast-acting, arcless switch for a high current circuit, according to claim 8, wherein:

said cutter surface is an internal surface of said cylindrical cutter, and the first surface of said foil element is said outer surface.

11. An explosive-actuated, high-impedance, fast-acting, arcless switch for opening a high current circuit, according to claim 1, wherein:

said conductive foil comprises copper.

12. An explosive-actuated, high-impedance, fast-acting, arcless switch for opening a high current circuit, according to claim 3, wherein:

said flexible dielectric layer comprises Teflon (TM).

13. An explosive-actuated, high-impedance, fast-acting, arcless switch for opening a high current circuit, according to claim 8, wherein:

said hard dielectric cutter comprises a phenolic resin.

14. A method for switching a high current through a switch in an electrical circuit, said switch including a highly conductive frangible element disposed against a hard dielectric groove pattern, comprising the steps of:

conducting said high current between first and second terminals of said switch through said highly conductive frangible element; and generating a controlled explosion to drive said conductive element against said groove pattern with a force sufficient to rupture said conductive element against said groove pattern to provide a current path of increased electrical impedance between said terminals.

* * * * *